US005911092A

United States Patent [19]

Hotta et al.

[11] Patent Number: 5,911,092

[45] Date of Patent: Jun. 8, 1999

[54] IMAGE FORMING APPARATUS

[75] Inventors: Ikuya Hotta; Masaru Ushio; Junji Sato; Yoshinao Kitahara, all of Tokyo, Japan

[73] Assignee: Konica Corporation, Tokyo, Japan

[21] Appl. No.: 08/995,372

[22] Filed: Dec. 22, 1997

[30] Foreign Application Priority Data

Dec. 27, 1996 [JP] Japan ..... 8-350257

[51] Int. Cl.[6] ..... G03G 21/00

[52] U.S. Cl. ..... 399/21; 399/8; 399/361

[58] Field of Search ..... 399/8, 21, 361, 399/381

[56] References Cited

U.S. PATENT DOCUMENTS 5,012,281 4/1991 Kusumoto et al. .
5,424,808 6/1995 Maekawa et al. .
5,708,908 1/1998 Hirata et al. ..... 399/8
5,715,496 2/1998 Sawada et al. ..... 399/8

*Primary Examiner*—Richard Moses
*Attorney, Agent, or Firm*—Frishauf, Holtz, Goodman, Langer & Chick

[57] ABSTRACT

An apparatus for forming an image on a recording sheet comprises a jam data holder storing a predetermined number of jam occurrence data arranged in time sequence, whereby when the jam data holder receives the newest jam occurrence data, the jam data holder adds the newest jam occurrence data into the predetermined number of jam occurrence data and eliminates the oldest jam occurrence data from the predetermined number of jam occurrence data; a calculator for calculating jam occurrence frequency when the jam data holder receives the newest jam occurrence data, wherein the calculator references the jam occurrence data from the predetermined number of jam occurrence data stored in the jam data holder, calculates a number N of jam occurrences, the total sheet number T1 when the oldest jam occurrence was detected and the total sheet number T2 when the newest jam occurrence was detected and calculates a jam occurrence frequency based on the difference between the total sheet number T2 and the total sheet number T1 and the number N of jam occurrence; and a signal generator to output a jam frequently-occurring signal when the number of jam occurrence is larger than a first predetermined number and the jam occurrence frequency is larger than a second predetermined number.

8 Claims, 5 Drawing Sheets

IMAGE FORMING APPARATUS

BACKGROUND OF THE INVENTION

The present invention relates to an electro-photographic type image forming apparatus, and particularly to an image forming apparatus capable of detecting a current state of how frequently jamming is occurring.

In an image forming apparatus such as a copying machine and a printer, a document and a copy paper pass through a complicated path to be conveyed. Therefore, paper clogging (i.e., a conveyance error referred to as jamming) may occur.

In an ordinary image forming apparatus, immediately after the occurrence of jamming, operation of the apparatus is stopped, and the display section shows codes (jamming codes) indicating that jamming has has occurred and where aforesaid jamming occurred.

Incidentally, if, in aforesaid kind of image forming apparatus, jamming occurs at a specific portion, it is considered to be necessary that maintenance of aforesaid section is necessary. Due to aforesaid request, it has been considered that it is necessary to detect whether jamming is occurring frequently for each portion.

When detecting whether jamming is frequently occurring, jam occurrence frequency is calculated from the counted value of processed sheets (i.e., a number of copy papers or a passed number of documents) for each portion and the jam occurrence counted value. If the jam occurrence count number and the jam occurrence frequency surpass prescribed values, a warning is given.

If it is detected that jamming is occurring frequently from the counted value of processed sheets, a timewise factor is not added. Therefore, the detection results may be different from the current perception of the users.

In addition, in the conventional detection operation for detecting whether jamming is occurring frequently, the detected results could not easily be known at a remote location. Namely, the detected results were only displayed on a display section on an apparatus where jamming occurred. Thus a maintenance man positioned remote from the apparatus could not know of the occurrence of a malfunction of the apparatus.

SUMMARY OF THE INVENTION

The present invention was contrived against aforesaid problems. An objective of the present invention is to provided an image forming apparatus capable of obtaining results closer to the current perception of the user without respect to whether jamming is occurring frequently.

Another objective of the present invention is to provide an image forming apparatus capable of transferring the results of jamming frequency detection to remote equipment.

The above-mentioned objectives can be attained by the constitutions described below:

Constitution (1)

An image forming apparatus having jam occurrence count data and passed paper counting data for each of jam occurrence point of copy paper and document, comprising a jam data retention means which retains a prescribed number of information about jam occurrence point and jam occurrence day and time in the order in which jam occurrence time is new, a jam occurrence frequency calculating means which calculates jam occurrence frequency for each of a prescribed occurrence point from information about the point of jam occurrence, a processed data retention means which retains counted data composed of the number of passed copy paper and the number of passed document, a calculation means which calculates jam occurrence frequency for each of a prescribed area by means of jamming number in the relevant area occupied in a prescribed jamming number and the difference the total passed paper count when the oldest data, among the retained jam data, are acquired and the total passed paper number when the updated data, among the retained jam data and a jam frequently-occurring signal which occurs a jam frequently-occurring signal when number of passed paper for each of the above-mentioned area surpass a prescribed value and, simultaneously with this, when the number of passed paper for each area passes a prescribed value.

According to an invention on an image forming apparatus, due to jamming number in the relevant area per a prescribed jamming number and the difference between the total passed paper count when the oldest data, among the retained jam data, are acquired and the total passed paper number when the updated data, among the retained jam data, jam occurrence frequency for each of a prescribed area. When jam occurrence frequency for each area surpasses a prescribed value and when the number of passed paper for each of area surpasses a prescribed value, a jam frequently-occurring signal occurs.

Incidentally, a prescribed jamming number when jamming number in the relevant area occupied in a prescribed jamming number means the number of prescribed jam data retained.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with a conventional method in which the jamming occurring frequency is evaluated only with the number of paper passed, the results of detection closer to the sense of user can be obtained by the use of timewise frequency.

Constitution (2)

The image forming apparatus described in constitution 1 above, wherein

According to an invention on an image forming apparatus, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, dividing into the image forming apparatus main body side and the document feeding device side. When jam occurrence frequency of these surpass a prescribed value and, simultaneously with this, when the number of passed paper for each area passes a prescribed value, the jam frequently-occurring signal occurred.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency (data of prescribed number of jamming which occurred at the closest time to the current time {the point of jam occurrence, the number of image forming sheet (the number of copying paper passed) or the number of document passed}) and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with detecting how jamming is occurring frequently by calculating jamming frequency only by copy counting, the results of detection closer to the sense of user can be obtained by the use of timewise frequency.

Since jam occurrence frequency can be operated, dividing into the image forming apparatus main body side and the document feeding device side, detection is conducted for each the related area. Therefore, the results of detection closer to the sense of user can be obtained.

Constitution (3)

The image forming apparatus described in Constitution 1, wherein jam frequently-occurring signal occurrence means occurs jam frequently-occurring signal for each of area where jamming occurs.

According to an invention on an image forming apparatus, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, each area related to jam occurrence. When jam occurrence frequency of these surpass a prescribed value and, simultaneously with this, when the number of passed paper for each area passes a prescribed value, the jam frequently-occurring signal occurred.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, the results of detection closer to the sense of user can be obtained by the use of timewise frequency.

Jam occurrence frequency can be measured for each of area. Therefore, detection results close to the sense of user can be obtained, since detection for each relevant is conducted. Simultaneously with this, more delicate information about how jamming is occurring frequently can be disclosed.

Constitution (4)

The image forming apparatus described in either of the above-mentioned constitution 1 through 3, providing with a communication means which transfers jam frequently-occurring signal from a jam frequently-occurring signal occurrence means to equipment outside.

According to an invention on an image forming apparatus, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, each area related to jam occurrence. When jam occurrence frequency of these surpass a prescribed value and, simultaneously with this, when the number of passed paper for each area passes a prescribed value, the jam frequently-occurring signal occurred. By means of a communication means such as a modem, a jam frequently-occurring signal is transferred to equipment outside (a host computer) through a communication circuit.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, the results of detection closer to the sense of user can be obtained by the use of timewise frequency.

Since aforesaid jam frequently-occurring signal is transferred to equipment outside such as the host computer, a maintenance man can hold the condition of the image forming apparatus through the equipment outside.

By the use of a remote diagnosis system, the maintenance man can hold information about the cause and the condition of jamming frequently occurring. Therefore, prompt inspection and repair can be conducted.

DETAILED DESCRIPTION OF THE PREFERRED EMBODIMENT

Hereinafter, an image forming apparatus of the present invention and its operation will be explained referring to attached drawings.

<Mechanical constitution>

Here, mechanical overall structure of an image forming apparatus of the embodiment of the present invention will be explained referring to FIG. 2. Incidentally, as image forming apparatus 100, a copying machine is exemplified to be explained.

Figure 2:
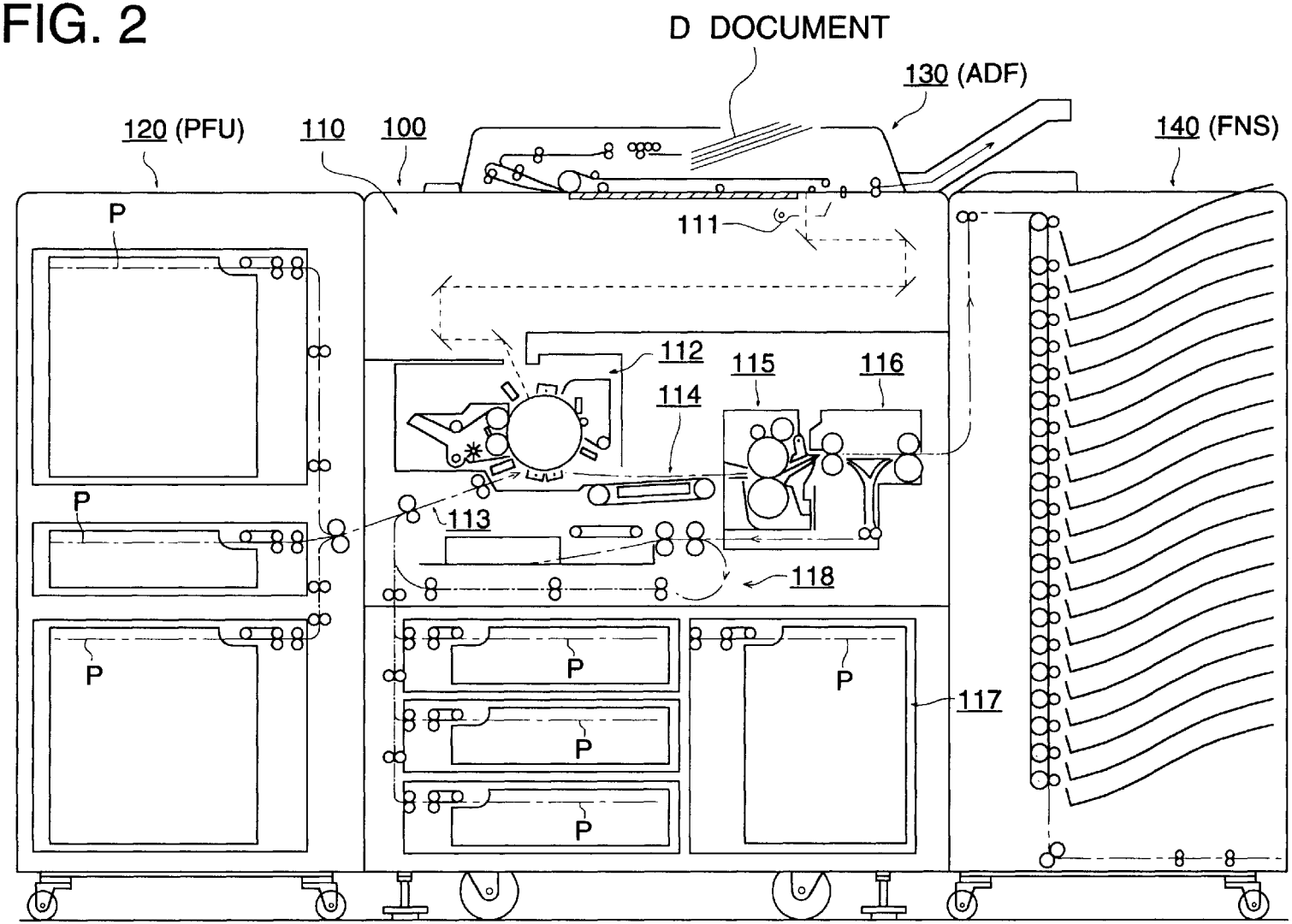
FIG. 2 is a block diagram showing mechanical constitution of an image forming apparatus used in the embodiment of the present invention.

In FIG. 2, numeral 110 represents an electrophotographic copying machine main body, numeral 120 represents a paper feeding unit (PFU device), numeral 130 represent an automatic document feeding device and numeral 140 represents a post-processing device (sorter).

Above image forming apparatus 100, automatic document feeding device 130 is provided. Image forming apparatus 100 is controlled by ADF control section 130C described later. Document D set on the document loading tray is fed onto the document loading by means of a conveyance mechanism. Document D loaded onto aforesaid document loading plate is discharged onto the document receiving section by means of a conveyance mechanism at timing of the finish of exposure. Inside aforesaid automatic document feeding device 130, plural sensors which detects ADF jam that a document jam occurs inside the automatic document feeding device (ADF) are provided.

Electro-photographic copying machine 110 entirely scans slit-shaped beam against document D. Aforesaid electro-photographic copying machine main body 110 introduces beam reflected from document D onto the photoreceptor drum through mirrors and lenses. Aforesaid electro-photographic copying machine main body 110 is composed of scanning and exposure section 111 which forms an electro-static latent image on the photoreceptor drum, image forming section 112 which visualizes the electro-static latent image on the photoreceptor drum by a developer and transfers it on copy paper P, paper feeding section 113 which feeds copy paper P onto image forming section 112, conveyance section 114 which conveys copy paper P, fixing section 115 which fixes toner on copy paper P by means of heat, discharging-switching section 116 which switches discharged tray on which copy paper P after fixing is discharged, plural paper feeding cassettes 117 and copy paper re-feeding device for double-sided copying (ADU) 118.

Figure 1:
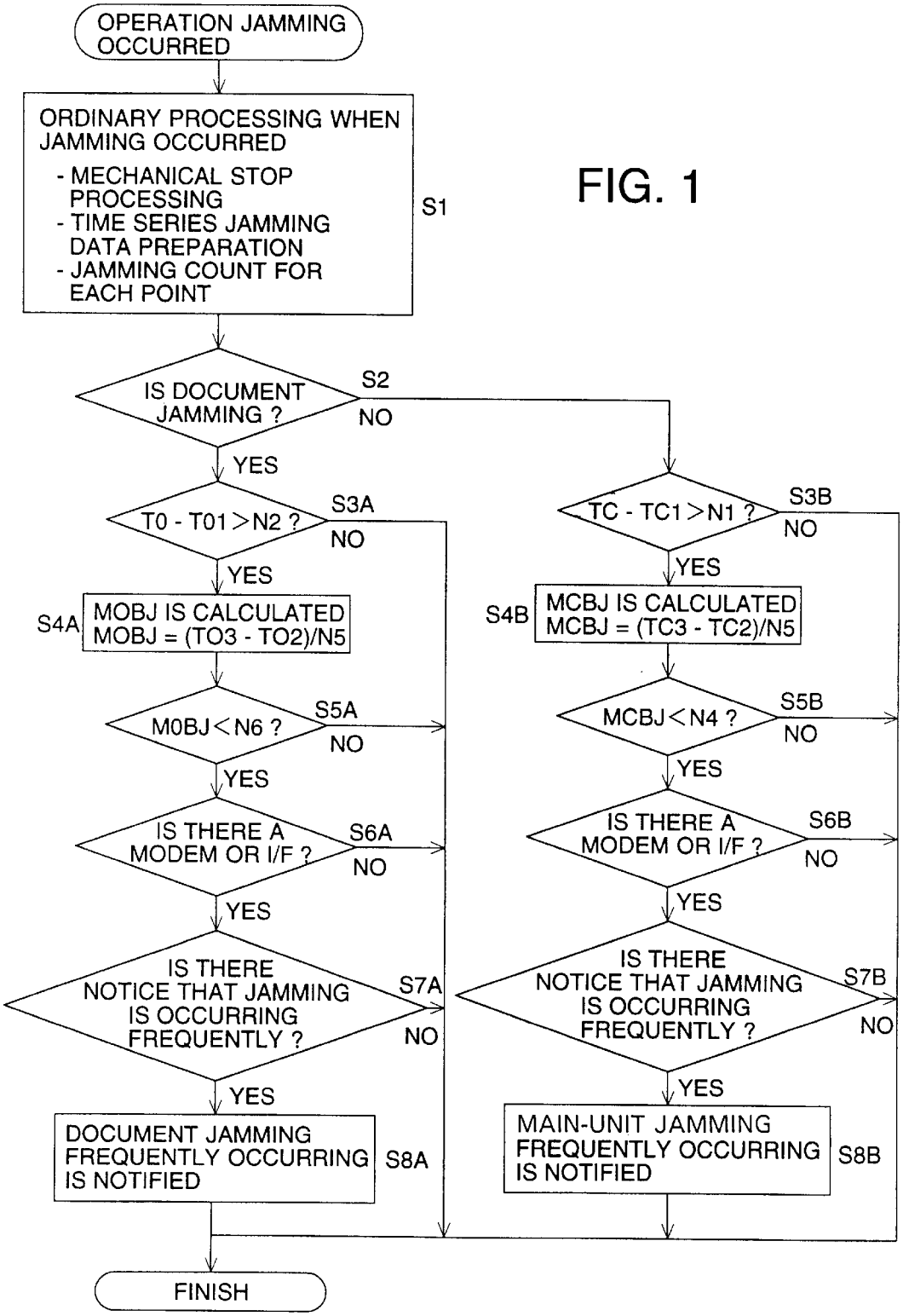
Fig. 1 is a flow chart showing operation for detecting whether jamming is occurring frequently in an embodiment.

In FIG. 1, a dashed line shows a conveyance path of copy paper P. Aforesaid conveyance path includes a main path and a circulation path. During aforesaid conveyance path, plural sensors which detect jamming in the main body (jamming caused by a copy paper which occurs in the electro-photographic copying machine main body) are located.

Through the main path, copy paper P housed in paper feeding cassette 117 or paper feeding unit 120 provided below electrophotographic copying machine main body (Main Unit) 110 is subjected to image forming in image forming section 112, and then housed in post-processing device 140 after passing conveyance section 114, fixing section 115 and paper-discharging section 116.

On the other hand, through the circulation path, copy paper P which has been branched from paper discharging path 116 is temporarily stored in copy paper re-feeding device for double-sided copying 118, and then is re-fed to reach paper feeding section 113 of electrophotographic copying machine main body 110.

<Electrical constitution>

Figure 3:
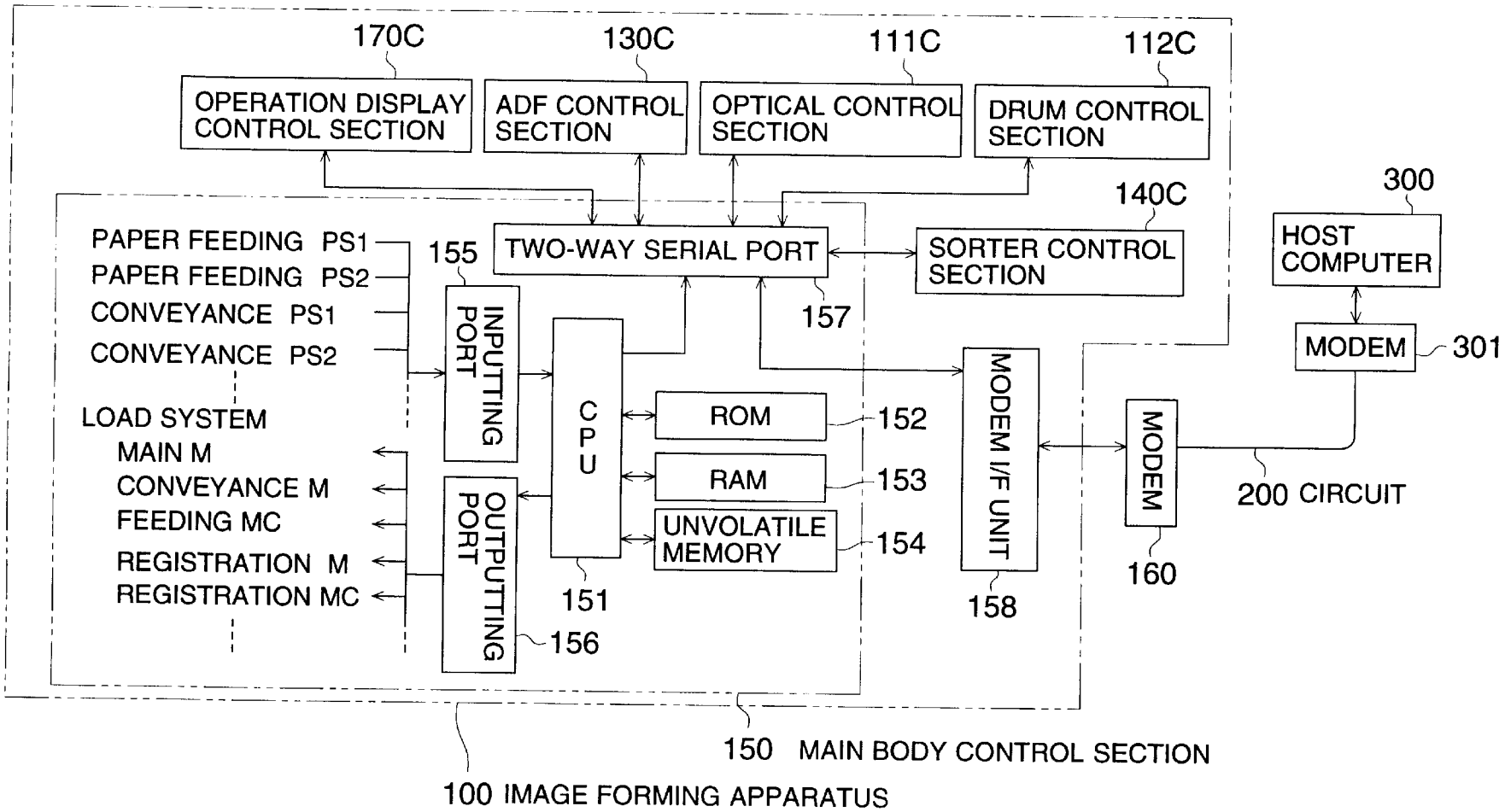
FIG. 3 is a block diagram showing an electrical constitution used in the embodiment of the present invention.

Image forming apparatus 100 constituted as above is constituted as shown in FIG. 3 in terms of electricity.

As shown in FIG. 3, image forming apparatus 3 is composed of optical control section 111C which controls scanning and exposure section 111, photoreceptor drum control section 112C which controls photoreceptor drum 112, ADF control section 130C which controls automatic document feeding device 130, sorter control section 140C which controls post-processing device 140, scanning and displaying control section 170C which controls the operation section where each operation is conducted and the displaying section which conducts each display and main body control section 150 which controls each section in electro-photographic copying machine main body 110.

Modem 160 which conducts modulation/demodulation for communicating with apparatuses outside the main body is constituted connectable with image forming apparatus 100. Incidentally, aforesaid modem can be provided inside image forming apparatus 100.

The above-mentioned main body control section 150 is composed of CPU 151 as a calculation means, ROM 152 where a processing program is housed, RAM 153 which is used as an operation memory when executing processing, non-volatile memory 154 which houses each kind of set data and data to be retained, inputting port 155 for inputting a detection signal from each sensor (jamming detection sensor)into CPU 151, outputting port 156 for outputting instruction from CPU 151 to each motor, two-way serial port 157 which serial-connects each of the above-mentioned control sections, CPU 151 and modem I/F unit 158 which controls communication control for transferring a signal that jamming is occurring frequently sent by CPU 151 to external equipment (such as host computer 300).

Electro-communication circuit equipment 200 (hereinafter, simply referred as circuit 200) means each circuit, which not only includes a public circuit and a private circuit but also a wireless transfer path employing an electric wave, infrared beam and visible beam.

Host computer 300 represents a computer (explained later) located in the vicinity of a maintenance man for maintaining and controlling image forming apparatus 100. Host computer 300 is constituted capable of communicating with image forming apparatus 100 through circuit 200 by means of modem 301.

<Operation of an image forming apparatus>

Hereinafter, referring to FIG. 1, operation for detecting whether or not jamming is occurring frequently in Embodiment of the present invention will be explained.

FIG. 1 is a subroutine showing processing jamming during operation (jamming which occurs during operation for image forming). Aforesaid subroutine is called simultaneously with the occurrence of jamming during operation in the course of processing program of the main operation in CPU 151.

If jamming occurred either during the conveyance path of document D or copy paper P, CPU 151 which received a detection signal from a jamming detection sensor at the relevant point calls operation jamming routine from the main operation program, when CPU 151 executes ordinary processing when jamming occurred (see FIG. 1, S1).

As ordinary processing when aforesaid jamming occurred, mechanical operation of each section of image forming apparatus 100 is caused to stop. Simultaneously with this, time series jam data are prepared and jamming counting for each point is conducted.

Here, "time series jam data" accumulates jamming information about prescribed number of the occurrence (for example, 100 instances in the past or since maintenance service is conducted up to the present time), such as jamming cause code, occurrence month, occurrence day, occurrence hour, occurrence minute, occurrence paper feeding step, size used (copy paper/document) and magnification, when jamming occurred. Incidentally, "jamming counting for each point" means to count jamming for each of point where jamming occurred.

Aforesaid "time series jam data" and "jamming counting for each point" are retained in non-volatile memory 154.

In the case of ordinary processing, counted values such as the number of passed document TO (total document count) and the number of passed copy paper (image forming paper) TC (total copy count) are similarly retained in non-volatile memory 154. When jamming occurred, aforesaid TO and TC are retained by the time series jam data.

Incidentally, data used in the present embodiment are explained collectively.

<Data related to jamming of copy paper P>

TC: total copy count

TC1: TC when resetting jam data between stations (when conducting maintenance service)

TC2: Among the time series jam data, TC of the oldest main body jam data having TC larger than TC1 (provided that, when the number of Main-Unit jam data having TC data larger than TC1 is one, TC2=TC1.)

TC3: the current TC

N1: After jam data between stations are reset (maintenance service is conducted), a threshold value in order not to Z detect whether or not jamming occurs frequently until a prescribed number is copied.

N3: Number of Main-Unit jam which occurred between TC2 and TC3 (excepting TC2=TC1 and that jamming occurred at TC2).

N4: Threshold value to evaluate how the main body causes jamming frequently by means of the number of copying MCBJ per the occurrence of jamming in the main body.

<Data related to jamming of document D>

TO: total document count

TO1: TO when jam data between stations are reset (maintenance service is conducted)

TO2: Among the time series jam data, TO of the oldest main body jam data having TO larger than TO1 (provided that, when the number of Main-Unit jam data having TO data larger than TO1 is one, T02=TO1.)

T03: the current TO

N2: After jam data between stations are reset (maintenance service is conducted), a threshold value in order not to detect whether or not jamming occurs frequently until a prescribed number is copied.

N5: Number of Main-Unit jam which occurred between TO2 and TO3 (excepting TC2=TC1 and that jamming occurred at TO2).

N6: Threshold value to evaluate how the main body causes jamming frequently by means of the number of copying MOBJ per the occurrence of jamming in the main body.

After ordinary processing when the above-mentioned jamming occurred is executed, CPU 151 judges whether jamming occurred is ADF jam or Main-Unit jam referring to jamming cause code (see FIG. 1 S2). Due to aforesaid judgment result, if it falls on ADF jam, ADF jam frequently-occurring judging routine (see FIG. 1 S3A–S8A) is called. If it falls on Main-Unit jam, Main-Unit jam frequently-occurring judging routine (see FIG. 1 S3B–S8B) is called.

(1) ADF jam frequently-occurring judging routine is called when ADF jam occurs frequently When jamming occurred falls on ADF jam, referring to data housed in non-volatile memory 154 and each register, CPU 151 calculates difference between total document count TO when ADF jam occurred and total document count TO1 when jam data between stations are reset (when maintenance service is conducted) (TO–TO1), and investigates whether or not aforesaid difference (the number of passed document after conducting the maintenance service) is larger than threshold value N2 (see FIG. 1 S3A)

If aforesaid difference is lower than threshold value N2, the following ADF jam frequently-occurring judging routine is called when ADF jam occurs frequently is not executed to be finished. This is because that reliability to judge whether or not jamming is occurring frequently is lowered before a certain number of documents are passed.

In addition, if the number of passed document after maintenance service is executed is larger than N2, number of passed paper per the number of the occurrence of ADF jam MOBJ is calculated (see FIG. 1 S4A).

Number of passed paper per the number of the occurrence of ADF jam MOBJ can be represented as follows:

$$MOBJ=(TO3-TO2)/N5$$

By utilizing jamming number N5 in the relevant area (a document feeding device) occupied in a prescribed jamming number and the difference between the total passed paper number when the oldest data, among the retained jam data, are acquired and the total passed paper number when the updated data, among the retained jam data (TO3–TO2), number of paper passed per the number of the occurrence of ADF jam MOBJ is calculated. The inverse of aforesaid MOBJ means the frequency of the jam occurrence on the document feeding device side.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, due to aforesaid operation of jam occurrence frequency, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with a conventional method in which the jamming occurring frequency is evaluated only with the number of paper passed, the results of detection closer to the sense of user can be obtained by the use of timewise frequency as a parameter.

Number of paper passed per the occurrence of ADF jam MOBJ is compared with a prescribed threshold value N6 (see FIG. 1 S5A). If MOBJ is N6 or more, ADF jam is not occurring frequently. Therefore, the subroutine is finished. If MOBJ is less than N6, it is evaluated that ADF jam is occurring frequently.

If it is evaluated that ADF jam is occurring frequently, CPU 151 evaluates whether or not there occurs modem 160 by evaluating a prescribed signal (such as a DR signal) from modem 160 through two-way serial port 157. Similarly, CPU 151 evaluates whether or not there occurs modem I/F unit 158 by a prescribed signal from modem 160 through two-way serial port 157.

There also exist an image forming apparatus in which neither aforesaid modem I/F unit 158 nor modem 160 are connected (provided). If they are not connected, a message that ADF jam is occurring frequently is displayed on the display section to be finished.

In the case of an image forming apparatus in which aforesaid modem I/F unit 158 and modem 160 are connected, CPU 151 investigates ON/OFF of the setting of jamming frequently-occurring notice (the image forming apparatus is so set that setting of ON/OFF is possible). If the setting of the notice is OFF, ADF jam frequently-occurring notice is not conducted and the subroutine is finished. If the setting of the notice is ON, ADF jam frequently-occurring notice is conducted (see FIG. 1 S7A).

If ADF jam frequently-occurring notice is conducted, CPU 151 provides instruction for ADF jam frequently-occurring notice to modem I/F unit 158 through two-way serial port 157.

Modem I/F unit 158 which received aforesaid instruction conducts ADF jam frequently-occurring notice to host computer 300 by the use of modem 160 (see FIG. 1 S8A). In this occasion, to host computer 300, in addition to commands and parameters which exhibit ADF jam frequently occurring, MOBJ value, serial number of image forming apparatus 100 and host computer ID are sent.

In addition, when sending aforesaid information, it is possible to send data which has directly no relation with jamming frequently occurring such as TC and TO when jamming is frequently occurring, jamming count for each of points where jamming occurred, number of jamming for each maintenance service call and count data for each paper size.

Due to aforesaid ADF jam frequently-occurring notice, host computer 300 senses that ADF jam is frequently occurring on image forming apparatus 100, and then display status of image forming apparatus 100 and information such as installed place. As a result, a maintenance man can determine the status of image forming apparatus 100.

(2) Main-Unit jam frequently-occurring judging routine is called when Main-Unit jam occurs When jamming occurred falls on Main-Unit jam, referring to data housed in non-volatile memory 154 and each register, CPU 151 calculates difference between total copy count TC when Main-Unit jam occurred and total copy paper count TC1 when jam data between stations are reset (when maintenance service is conducted) (TC–TC1), and investigates whether or not aforesaid difference (the number of passed copy sheets after conducting the maintenance service) is larger than threshold value N3 (see FIG. 1 S3B).

If aforesaid difference is lower than threshold value N3, the following Main-Unit frequently-occurring judging routine is called when Main-Unit jam occurs frequently is not executed to be finished. This is because that reliability to judge whether or not jamming is occurring frequently is lowered before a certain number of copy sheets are passed.

In addition, if the number of passed copy paper after maintenance service is executed is larger than N3, number of passed paper per the number of the occurrence of Main-Unit jam MCBJ is calculated (see FIG. 1 S4B).

Number of passed paper per the number of the occurrence of Main-Unit jam MCBJ can be represented as follows:

$$MCBJ=(TC3-TC2)/N3$$

By utilizing jamming number N3 in the relevant area (an image forming apparatus main body) occupied in a prescribed jamming number and the difference between the total passed paper number when the oldest data, among the retained jam data, are acquired and the total passed paper number when the updated data, among the retained jam data (TC3 - TC2), number of paper passed per the number of the occurrence of Main-Unit jam MCBJ is calculated. The inverse of aforesaid MCBJ means the frequency of the jam occurrence on the image forming apparatus side.

Namely, due to aforesaid operation of jam occurrence frequency, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with a conventional method in which the jamming occurring frequency is evaluated only with the number of paper passed, the results of detection closer to the sense of user can be obtained by the use of timewise frequency as a parameter.

Number of paper passed per the occurrence of Main-Unit jam MCBJ is compared with a prescribed threshold value N4 (see FIG. 1 S5B). If MCBJ is N4 or more, Main-Unit jam is not occurring frequently. Therefore, the subroutine is finished. If MCBJ is less than N4, it is evaluated that Main-Unit jam is occurring frequently.

If it is evaluated that Main-Unit jam is occurring frequently, CPU 151 evaluates whether or not there occurs modem 160 by evaluating a prescribed signal (such as a DR signal) from modem 160 through two-way serial port 157. Similarly, CPU 151 evaluates whether or not there occurs modem I/F unit 158 by a prescribed signal from modem 160 through two-way serial port 157.

There also exist an image forming apparatus in which neither aforesaid modem I/F unit 158 nor modem 160 are connected (provided). If they are not connected, a message that Main-Unit jam is occurring frequently is displayed on the display section to be finished.

In the case of an image forming apparatus in which aforesaid modem I/F unit 158 and modem 160 are connected, CPU 151 investigates ON/OFF of the setting of jamming frequently-occurring notice (the image forming apparatus is so set that setting of ON/OFF is possible). If the setting of the notice is OFF, Main-Unit jam frequently-occurring notice is not conducted and the subroutine is finished. If the setting of the notice is ON, calling that Main-Unit jam frequently-occurring notice is conducted (see FIG. 1 S7B).

If the Main-Unit jam frequently-occurring notice is conducted, CPU 151 provides instruction for the Main-Unit jam frequently-occurring notice to modem I/F unit 158 through two-way serial port 157.

Modem I/F unit 158 which received aforesaid instruction conducts the Main-Unit jam frequently-occurring notice to host computer 300 by the use of modem 160 (see FIG. 1 S8B). In this occasion, to host computer 300, in addition to commands and parameters which exhibit Main-Unit jam frequently-occurring, MOBJ value, serial number of image forming apparatus 100 and host computer ID are sent.

In addition, when sending aforesaid information, it is possible to send data which has directly no relation with jamming frequently occurring such as TC and TO when jamming is frequently occurring, jamming count for each of points where jamming occurred, number of jamming for each maintenance service call and count data for each paper size.

Due to aforesaid Main-Unit jam frequently-occurring notice, host computer 300 senses that Main-Unit jam is frequently occurring on image forming apparatus 100, and then display status of image forming apparatus 100 and information such as installed place. As a result, maintenance man can hold the status of image forming apparatus 100.

<Effects obtained by the present embodiment>

(1) Due to aforesaid operation of jam occurrence frequency, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with a conventional method in which the jamming occurring frequency is evaluated only with the number of paper passed, the results of detection closer to the sense of user can be obtained by the use of timewise frequency.

(2) Since areas where jamming occurs are separated into the image forming apparatus main body and the document feeding device for detecting the frequency of jam occurrence, detecting is conducted for each related area. Therefore, detection results close to the sense of the user can be obtained.

(3) Since a jam frequently-occurring signal is transferred to equipment outside such as a host computer, a maintenance man can hold the condition of the image forming apparatus by means of aforesaid equipment outside.

(4) By the use of a remote diagnosis system, the maintenance man can hold information about the cause and the condition of jamming frequently occurring. Therefore, prompt inspection and repair can be conducted.

<The other embodiment (1)>

In the above-mentioned embodiment, ADF jam and Main-Unit jam are explained. In addition, PFU jamming in PFU 120 and FNS jamming in post-processing device 140 may be detected.

In addition, Main-Unit jam may be divided into several areas. For example, image forming jamming which occurs around image forming unit 112, paper feeding jamming which occurs around paper feeding cassette 117 or paper feeding section 113, paper discharging jamming which occurs around fixing section 115 and paper discharging switching section 116. Thus, the above-mentioned MCBJ is operated for each relevant area for detecting whether jamming is occurring frequently.

As described above, jam occurrence frequency can be measured for each of area in the main body. Therefore, detection results close to the sense of user can be obtained. Simultaneously with this, the condition how jamming is occurring frequently can be held by the controller. Namely, more delicate information about how jamming is occurring frequently can be disclosed.

<The other embodiment (2)>

Figure 4:
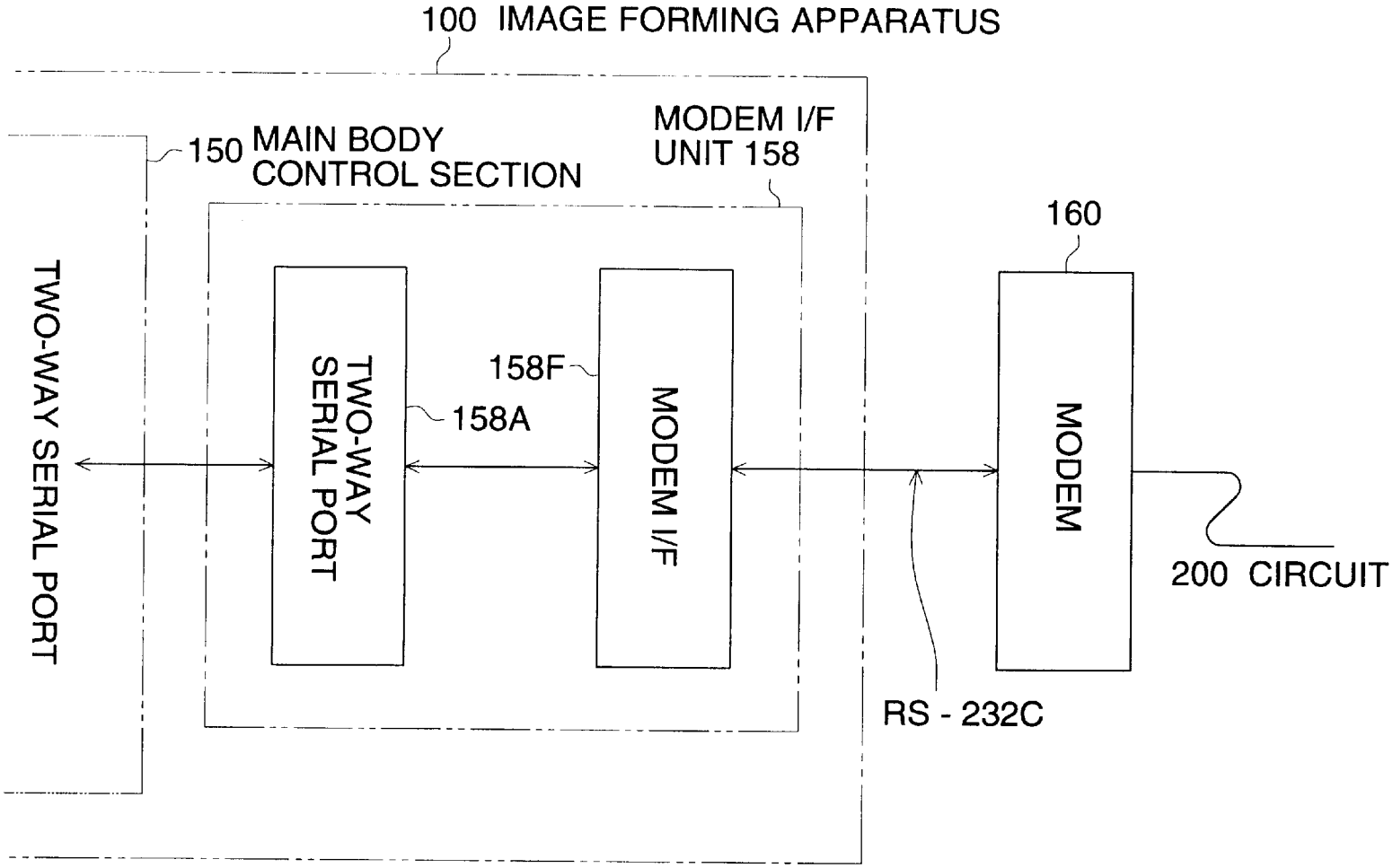
FIG. 4 is a block diagram showing an example of a detailed constitution of an electrical modem I/F.
Figure 5:
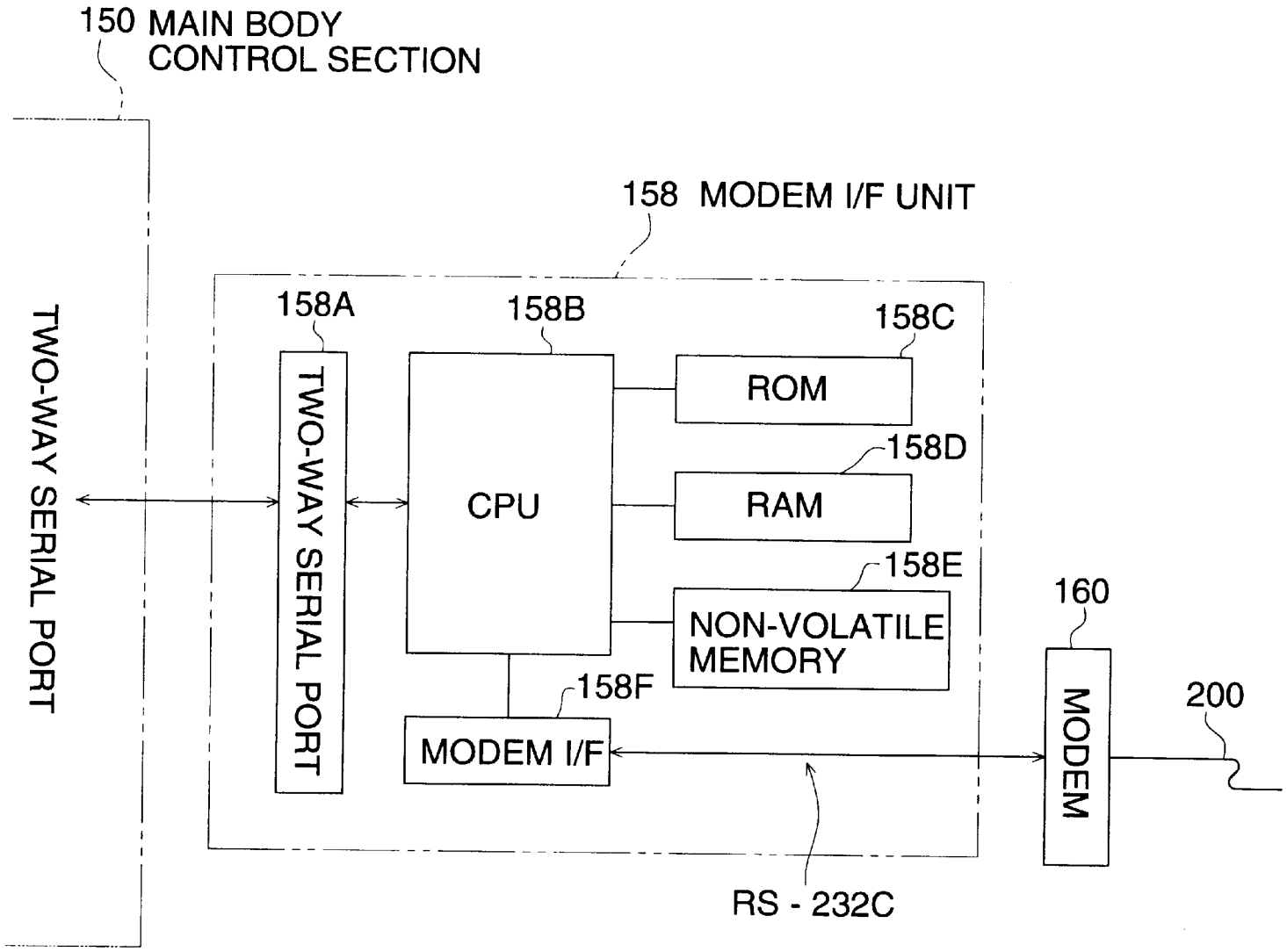
FIG. 5 is a block diagram showing detailed constitution of modem I/F unit of electrical constitution.

As described above, modem I/F unit 158 which conducts communication control can be constituted as shown in FIGS. 4 and 5.

Modem I/F unit 158 in FIG. 4 exhibits one example in which aforesaid modem I/F unit 158 is constituted of two-way serial port 158A and modem I/F 158F including RS-232C circuit. In this occasion, communication processing program may be executed by CPU 151. Therefore, constitution of modem I/F unit side may be simplified.

Modem I/F unit 158 in FIG. 5 exhibits when it is composed of two-way serial port 158A, CPU 158B which constitutes control means for communication control, ROM 158C which houses a program for communication control, RAM 158D as an operation memory for communication control, non-volatile memory 158E in which each setting for communication control is retained and modem I/F 158F including an RS-232C circuit which connects with modem 160.

As described above, communication program may be executed inside modem I/F unit 158 by providing CPU 158B inside modem I/F unit 158, there is a merit that CPU 151 and ROM 152 on the main body side are not burdened. Therefore, in the case of an image forming apparatus in which communication functions are optional, it is preferable that CPU is provided in modem I/F unit.

If the main switch on image forming apparatus 100 is turned OFF, it is natural that CPU 151 is not operated. However, in such an occasion, there is a merit that communication is possible if modem I/F unit 158 is operable.

<Practical example>

Each of the above-mentioned threshold values N1, N2, N4 and N6 can be housed in non-volatile memory 154 in advance. In addition, it is also possible to be re-written. For example, either of

N1=100, 200, 500, 1000
N2=50, 100, 200, 300
N4=50, 100, 500, 1000
N6=25, 50, 100, 200 is set as a default value in advance. It may be modified to the other value. In addition, aforesaid value may be continuously variable.

EFFECTS OF THE INVENTION

As described as above in detail, according to the present invention, the following effects may be obtained.

(1) According to an invention on an image forming apparatus of Constitution 1, due to jamming number in the relevant area per a prescribed jamming number and the difference between the total passed paper count when the oldest data, among the retained jam data, are acquired and the total passed paper number when the updated data, among the retained jam data, jam occurrence frequency for each of a prescribed area. When jam occurrence frequency for each area surpasses a prescribed value and when the number of passed paper for each of area surpasses a prescribed value, a jam frequently-occurring signal occurs.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with a conventional method in which the jamming occurring frequency is evaluated only with the number of paper passed, the results of detection closer to the sense of user can be obtained by the use of timewise frequency.

(2) According to an invention on an image forming apparatus of Constitution 2, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, dividing into the image forming apparatus main body side and the document feeding device side. When jam occurrence frequency of these surpass a prescribed value and, simultaneously with this, when the number of passed paper for each area passes a prescribed value, the jam frequently-occurring signal occurred.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, compared with detecting how jamming is occurring frequently by calculating jamming frequency only by copy counting, the results of detection closer to the sense of user can be obtained by the use of timewise frequency.

Since jam occurrence frequency can be operated, dividing into the image forming apparatus main body side and the document feeding device side, detection is conducted for each the the related area. Therefore, the results of detection closer to the sense of user can be obtained.

(3) According to an invention on an image forming apparatus of Constitution 3, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, each area related to jam occurrence. When jam occurrence frequency of these surpass a prescribed value and, simultaneously with this, when the number of passed paper for each area passes a prescribed value, the jam frequently-occurring signal occurred.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, the results of detection closer to the sense of user can be obtained by the use of timewise frequency.

Jam occurrence frequency can be measured for each of area. Therefore, detection results close to the sense of user can be obtained, since detection for each relevant is conducted. Simultaneously with this, more delicate information about how jamming is occurring frequently can be disclosed.

(4) According to an invention on an image forming apparatus of Constitution 4, due to jamming number in the relevant area per a prescribed jamming number and the difference between the total passed paper count when the oldest data, among the retained jam data, are acquired and the total passed paper number when the updated data, among the retained jam data, jam occurrence frequency can be operated, each area related to jam occurrence. When jam occurrence frequency of these surpass a prescribed value and, simultaneously with this, when the number of passed paper for each area passes a prescribed value, the jam frequently-occurring signal occurred. By means of a communication means such as a modem, a jam frequently-occurring signal is transferred to equipment outside (a host computer) through a communication circuit.

Therefore, since the jam occurrence frequency is calculated by means of the data of prescribed number of jamming which occurred at the closest time to the current time, timewise factors can be added. Therefore, compared with detecting how jamming is occurring frequently by calculating jamming frequency only by copy counting, the results of detecting how jamming is occurring frequently which is closer to the sense of users.

Namely, the jam occurrence frequency is evaluated from timewise frequency [data of prescribed number of jamming which occurred at the closest time to the current time {the point of jam occurrence, the number of image forming sheet (the number of copying paper passed) or the number of document passed}] and jamming frequency per the number sheet passed (the total passed paper number when the oldest data, among the retained jam data, are acquired and the total passed paper number when the updated data, among the retained jam data). Therefore, how jamming is occurring frequently is detected under a state including timewise factors. Namely, the results of detection closer to the sense of user can be obtained by the use of timewise frequency.

Since aforesaid jam frequently-occurring signal is transferred to equipment outside such as the host computer, a maintenance man can hold the condition of the image forming apparatus through the equipment outside.

By the use of a remote diagnosis system, the maintenance man can hold information about the cause and the condition of jamming frequently occurring. Therefore, prompt inspection and repair can be conducted.

What is claimed is:

1. An apparatus for forming an image on a recording sheet, comprising:

an image forming unit for conveying recording sheets and for forming an image on the recording sheets based on image information;

a counter for counting a sheet number of conveyed recording sheets and for memorizing a total sheet number of conveyed recording sheets;

a detector for detecting a jam occurrence in the image forming unit and for outputting jam occurrence data indicating a date of jam occurrence and a total sheet number when the jam occurrence was detected;

a jam data holder for storing a predetermined number of the jam occurrence data arranged in time sequence, whereby when the jam data holder receives a newest one of the jam occurrence data, the jam data holder adds the newest jam occurrence data into the predetermined number of jam occurrence data and selectively eliminates an oldest one of the jam occurrence data from the predetermined number of jam occurrence data;

a calculator for calculating jam occurrence frequency when the jam data holder receives the newest jam occurrence data, wherein the calculator references the jam occurrence data from the predetermined number of jam occurrence data stored in the jam data holder, calculates a number N of jam occurrences, a total sheet number T1 when the oldest jam occurrence was detected and a total sheet number T2 when the newest jam occurrence was detected, and calculates a jam occurrence frequency based on a difference between the total sheet number T2 and the total sheet number T1 and the number N of jam occurrence; and a signal generator for outputting a jam frequently-occurring signal when the number N of jam occurrence is larger than a first predetermined number and the jam occurrence frequency is larger than a second predetermined number.

2. The apparatus of claim 1, further comprising:

a document feeding unit for conveying document sheets to an image reading device to generate the image information, wherein the counter counts the sheet number of conveyed recording sheets and a sheet number of conveyed document sheets separately, and memorizes the total sheet number of conveyed recording sheets and a total sheet number of conveyed document sheets, and wherein the detector detects a a jam in either one of the document feeding unit and the image forming unit, and the jam occurrence data indicates which of the document feeding unit and the image forming unit is jammed.

3. The apparatus of claim 2, wherein the calculator references the jam occurrence data with respect to the jammed unit, and calculates the jam occurrence frequency of the jammed unit.

4. The apparatus of claim 3, wherein the signal generator outputs different jam frequently-occurring signals for each of the document feeding unit and the image forming unit.

5. The apparatus of claim 3, wherein the signal generator outputs different jam frequently-occurring signals for each jammed unit.

6. The apparatus of claim 1, further comprising communicating means for transmitting the jam-frequently occurring signal to an external control station for administering the apparatus.

7. The apparatus of claim 2, wherein the signal generator outputs different jam frequently-occurring signals for each of the document feeding unit and the image forming unit.

8. The apparatus of claim 2, wherein the signal generator outputs different jam frequently-occurring signals for each jammed unit.

* * * * *